US012013132B2

(12) United States Patent
Kim et al.

(10) Patent No.: US 12,013,132 B2
(45) Date of Patent: Jun. 18, 2024

(54) AIR CONDITIONER

(71) Applicant: LG ELECTRONICS INC., Seoul (KR)

(72) Inventors: Hankook Kim, Seoul (KR); Minkyu Park, Seoul (KR); Daehyeok Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 38 days.

(21) Appl. No.: 17/672,900

(22) Filed: Feb. 16, 2022

(65) Prior Publication Data

US 2022/0260261 A1 Aug. 18, 2022

(30) Foreign Application Priority Data

Feb. 17, 2021 (KR) ..... 10-2021-0021303

(51) Int. Cl.
*F24F 1/04* (2011.01)
*F24F 1/0063* (2019.01)
*F24F 13/02* (2006.01)

(52) U.S. Cl.
CPC ..... *F24F 1/04* (2013.01); *F24F 1/0063* (2019.02); *F24F 13/0272* (2013.01); *F24F 2221/26* (2013.01)

(58) Field of Classification Search
CPC ..... F24F 1/04; F24F 1/031; F24F 13/0254; F24F 13/0272
See application file for complete search history.

(56) References Cited

U.S. PATENT DOCUMENTS

2007/0068185 A1* 3/2007 Thompson ..... F24F 1/027 62/262
2012/0090344 A1* 4/2012 Cho ..... E06B 7/03 62/262

FOREIGN PATENT DOCUMENTS

CN 110793106 A * 2/2020 ..... F24F 1/031
CN 110878970 A * 3/2020 ..... F24F 1/031
KR 20-0287575 8/2002

(Continued)

OTHER PUBLICATIONS

CN110793106A Translation (Year: 2020).*

(Continued)

*Primary Examiner* — Schyler S Sanks
(74) *Attorney, Agent, or Firm* — KED & ASSOCIATES, LLP

(57) ABSTRACT

An air conditioner is provided that may include a case in which a heat exchanger is disposed and having an air inlet and an air outlet; a discharge pipe that communicates with the air outlet and extends outside of the case; and a kit having a discharge port in which the discharge pipe is fixed, and configured to be disposed at a window frame. The kit may include a main board in which the discharge port is formed; at least one sub-board configured to be movable up and down with respect to the main board; a rack connected with one of the main board or the at least one sub-board and forming a plurality of grooves spaced apart from each other in an upward-downward direction; and a holder connected with the other one of the main board or the at least one sub-board and having a protrusion inserted into one of the plurality of grooves to restrict upward-downward movement of the at least one sub-board.

23 Claims, 14 Drawing Sheets

(56) References Cited

FOREIGN PATENT DOCUMENTS

| | | |
|---|---|---|
| KR | 20-2008-0004797 | 6/2009 |
| KR | 10-2019-0013750 | 2/2019 |
| KR | 10-2019-0113516 | 10/2019 |
| KR | 10-2039071 | 11/2019 |
| KR | 10-2020-0022402 | 3/2020 |
| KR | 10-2020-0135085 | 12/2020 |

OTHER PUBLICATIONS

CN110878970A Translation (Year: 2020).*
Korean Office Action dated Mar. 31, 2022 issued in KR Application No. 10-2021-0021303.
Korean Office Action issued in Application No. 10-2023-0185624 dated Feb. 28, 2024.

* cited by examiner

AIR CONDITIONER

CROSS-REFERENCE TO RELATED APPLICATION(S)

This application claims priority under 35 U.S.C. § 119 to Korean Application No. 10-2021-0021303, filed in Korea on Feb. 17, 2021, whose entire disclosure is hereby incorporated by reference.

BACKGROUND

1. Field

An air conditioner is disclosed herein.

2. Background

A portable air conditioner includes a heat pump, which includes a compressor, two heat exchangers, and an expansion valve, in a case. A blowing fan that moves air, which has exchanged heat through one heat exchanger, to an indoor space and a discharge pipe that discharges air that has exchanged heat with the other heat exchanger are disposed in the case of a portable air conditioner. The discharge pipe may have a long or extended pipe shape to discharge the air, which has exchanged heat in the portable air conditioner, to the outside.

A kit that fixes a discharge pipe is disposed on a window frame so that air is smoothly discharged to the outside through the discharge pipe. However, there is no structure that adjusts the height of the kits in accordance with various heights of window frames to fix the kits to the window frames in the related art, so there is a problem in that external air flows inside through a window.

Further, there is a problem in the related art in that even if the height of a kit can be adjusted, the gap between the kit and a window frame is not sealed well, so external air flows inside through the gap. Furthermore, there is a problem in that because the height of a kit is adjusted by fastening a screw, the kit is easily damaged by external forces.

A structure that adjusts the height of a kit by fastening a screw has been disclosed in Korean Publication No. 20-2008-0004797, which is hereby incorporated by reference, but there is a problem in that the screw is damaged by external forces, so that a lifespan of the kit is short. Further, there is no structure for sealing the gap between the kit and a window frame, so external air flows inside through the gap.

BRIEF DESCRIPTION OF THE DRAWINGS

Embodiments will be described in detail with reference to the following drawings in which like reference numerals refer to like elements, and wherein.

DETAILED DESCRIPTION

Figure 1:
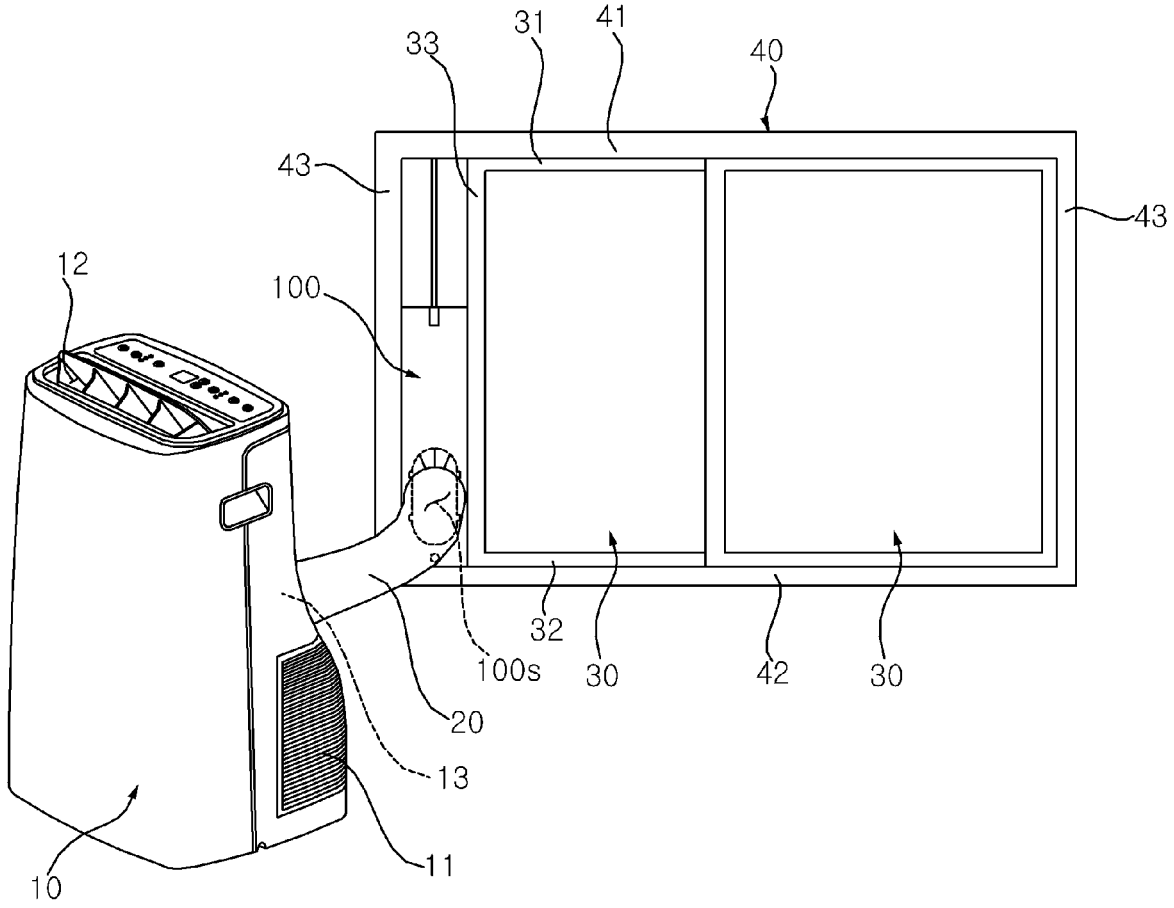
FIG. 1 is an installation view of an air conditioner according to an embodiment.

Advantages and features of embodiments, and methods of achieving them will be clear by referring to exemplary embodiments that will be describe hereafter with reference to the accompanying drawings. However, the embodiments are not limited to the exemplary embodiments described hereafter and may be implemented in various ways, and the exemplary embodiments are provided to complete the description and let those skilled in the art completely know the scope and the embodiments are defined by claims. Like reference numerals indicate like components throughout the specification.

Hereinafter, an air conditioner according to embodiments will be described with reference to the drawings.

An installation structure of an air conditioner will be described with reference to FIG. 1. FIG. 1 shows an installation structure of a case 10, a discharge pipe 20, and a kit 100. An air conditioner may include case 10 having a heat exchanger (not shown) disposed therein, an air inlet 11, and air outlets 12 and 13; discharge pipe 20 that communicates with the air outlet 13 and extends outside of the case 10; and kit 100 having a discharge port 100*s* to which the discharge pipe 20 is fixed, and configured to be fixed to a window frame 40.

A first heat exchanger (not shown) and a second heat exchanger (not shown) through which air flowing inside through the air inlet 11 exchanges heat may be disposed in the case 10. The first heat exchanger (not shown) and the second heat exchanger (not shown) may be connected with each other through a refrigerant pipe (not shown), and an expansion device (not shown) may be disposed on the refrigerant pipe (not shown).

Some of the air flowing into the case 10 through the air inlet 11 may exchange heat through the first heat exchanger (not shown) and then may be supplied to the interior through the first outlet 12. The other of the air flowing in the case 10 through the air inlet 11 may exchange heat through the second heat exchanger (not shown) and then may flow to the discharge pipe 20 through the second outlet 13.

A first channel (not shown) through which the air flowing into the case 10 through the air inlet 11 flows toward the first outlet 12 through the first heat exchanger (not shown) and a second channel (not shown) through which the air flowing into the case 10 through the air inlet 11 flows toward the second outlet 13 through the second heat exchanger (not shown) may be independently formed in the case 10.

The discharge pipe 20 may communicate with the second outlet 13 and may extend toward an outdoor space. Air discharged out of the case 10 through the second outlet 13 may be discharged to the outdoor space through the discharge pipe 20.

The kit 100 may be configured to be fixed to the window frame 40 and may be connected with the discharge pipe 20. The kit 100 may fix the discharge pipe 20 such that the discharge pipe 20 is not movable. The discharge pipe 20 may be inserted and fixed in the discharge port 100*s*. Air flowing through the discharge pipe 20 may be discharged to the outdoor space through the discharge port 100*s*.

An entire external shape of the window frame 40 may be a rectangle. The window frame 40 may include an upper frame 41 connected with an upper portion of a window 30, a lower frame 42 connected with a lower portion of the window 30, and side frames 43 that connect the upper frame 41 and the lower frame 42.

An entire external shape of the window 30 may be a rectangle and a plurality of windows may be disposed inside of the window frame 40. The window 30 may include a first window frame 31 connected with the upper frame 41, a second window frame 32 connected with the lower frame 42, and a third window frame 33 that extends in an upward-downward direction and that connects the first window frame 31 and the second window frame 32.

The kit 100 may be disposed between the side frame 43 and the third window frame 33 and may be connected with each of the upper frame 41 and the lower frame 42.

Figure 2:
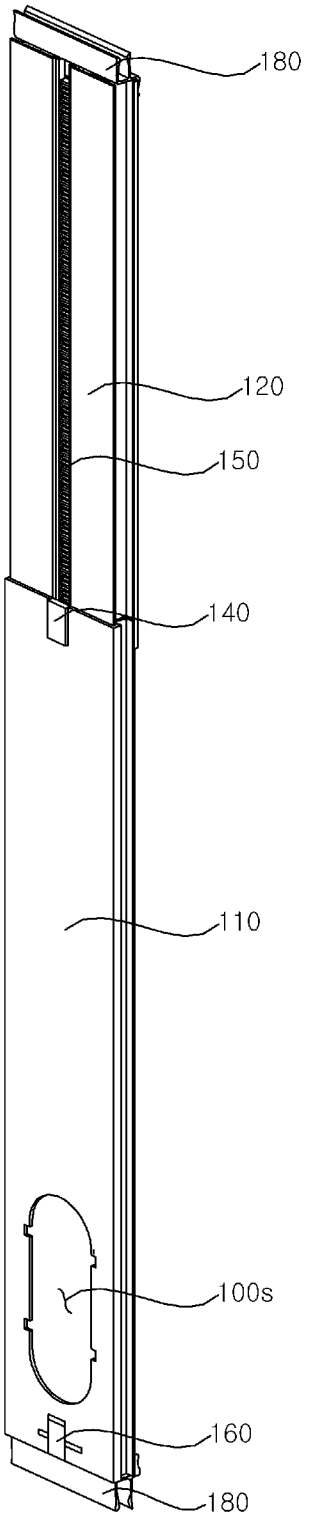
FIG. 2 is a perspective view of a first state of a kit according to an embodiment.
Figure 3:
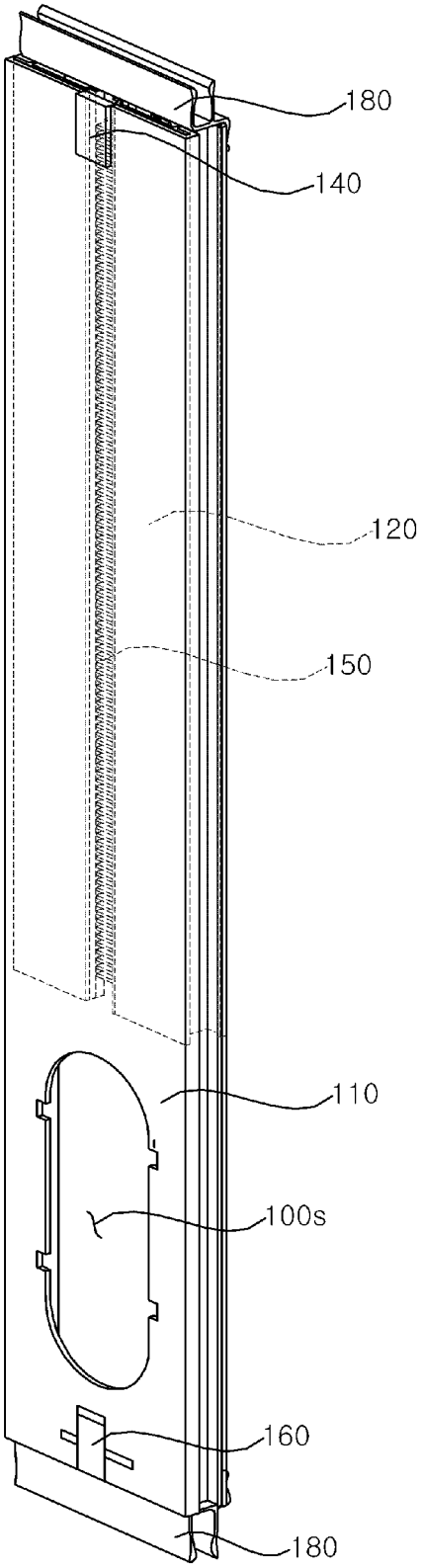
FIG. 3 is a perspective view of a second state of the kit according to an embodiment.
Figure 4:
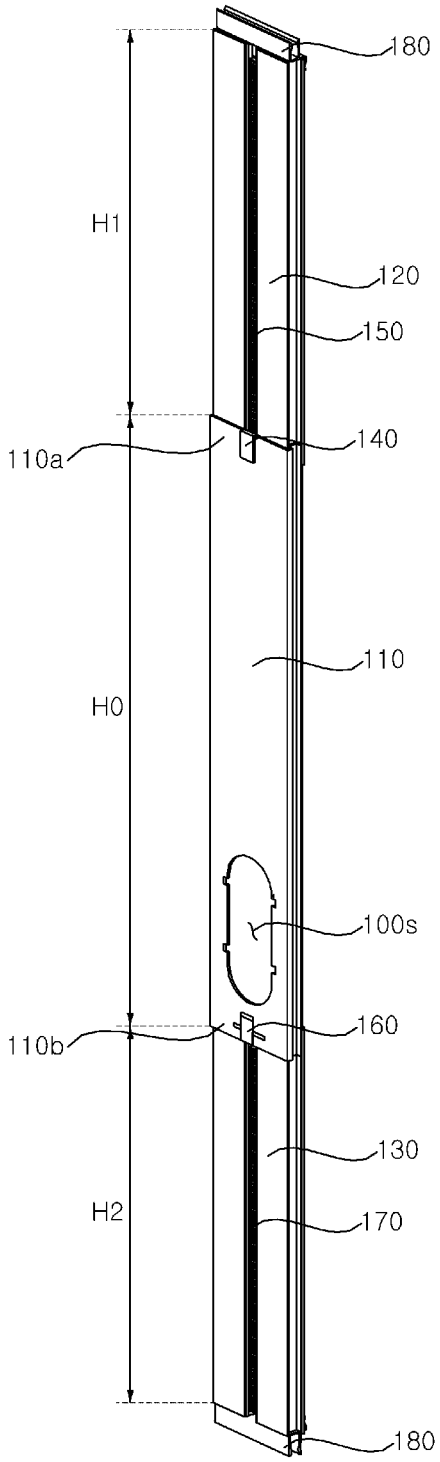
FIG. 4 is a perspective view of a third state of the kit according to an embodiment.

Hereafter, a connection relationship of a main board 110 and sub-boards 120 and 130 will be described with reference to FIGS. 2 to 4. FIG. 2 is a first state view in which first sub-board 120 is exposed upward from the main board 110. FIG. 3 is a second state view in which the first sub-board 120 is hidden in the main board 110. FIG. 4 is a third state view in which the first sub-board 120 is exposed upward from the main board 110 and second sub-board 130 is exposed downward from the main board 110.

The kit 100 may include the first main board 110 having the discharge port 100*s*, the first sub-board 120 at least partially disposed at an upper portion of the main board 110, and the second sub-board 130 at least partially disposed at a lower portion of the main board 110. The first sub-board 120 and the second sub-board 130 may be referred to as "sub-boards". The sub-boards 120 and 130 may be disposed to be movable in the vertical direction with respect to the main board 110.

The discharge port 100*s* may be formed at a position close to the first sub-board 120 and the second sub-board 130. The discharge port 100*s* may be positioned closer to a board lower end 110*b* than a board upper end 110*a* of the main board 110.

The kit 100 may include holders 140 and 160 disposed at any one of the main board 110 and the sub-boards 120 and 130, and racks 150 and 170 disposed at the other one of the main board 110 and the sub-boards 120 and 130. The holders 140 and 160 may be disposed at the main board 110. The holders 140 and 160 may include first holder 140 that restricts upward-downward movement of the first sub-board 120 and a second holder 160 that restricts upward-downward movement of the second sub-board 130.

The first holder 140 may be disposed at the upper portion of the main board 110 and the second holder 160 may be disposed at the lower portion of the main board 110. The first holder 140 and the second holder 160 may be disposed at ends of the main board 110. The first holder 140 may be disposed at the board upper end 110*a* of the main board 110 and the second holder 160 may be disposed at board lower end 110*b* of the main board 110.

The racks 150 and 170 may be disposed at the sub-boards 120 and 130. The racks 150 and 170 may include first rack 150 disposed at the first sub-board 120 and second rack 170 disposed at the second sub-board 130. The first rack 150 may extend in the upward-downward direction and may be disposed in parallel with the first sub-board 120. The second rack 170 may extend in the upward-downward direction and may be disposed in parallel with the second sub-board 130.

The kit 100 may include a supporter 180 that is attached/detached to/from at least any one of the sub-boards 120 and 130. The supporter 180 may be selectively attached/detached to/from the main board 110, the first sub-board 120, and/or the second sub-board 130.

Referring to FIG. 2, the first sub-board 120 may be exposed upward from the main board 110 in the first state. In the first state, the second sub-board 130 may not be connected to the main board 110.

The first holder 140 may be coupled to the first rack 150 and may restrict the first sub-board 120. The first holder 140 may restrict upward-downward movement of the first sub-board 120.

In the first state, a height of the kit 100 may be increased by a height of a first sub-board 120 exposed upward from the main board 110, as compared with when only the main board 110 is disposed. In the first state, the supporter 180 may be connected to each of the main board 110 and the first sub-board 120. A plurality of supporters 180 may be provided, for example, two supporters 180 may be provided. Any one of the plurality of supporters 180 may be connected to an upper side of the first sub-board 120 and the other one may be connected to a lower side of the main board 110. The supporter 180 connected to the upper side of the first sub-board 120 may seal a portion between the first sub-board 120 and the upper frame 41, and the supporter 180 connected to the lower side of the main board 110 may seal a portion between the main board 110 and the lower frame 42.

Referring to FIG. 3, the first sub-board 120 may be hidden inside of the main board 110 in the second state. In the second state, the second sub-board 130 may not be connected to the main board 110.

The first holder 140 may be coupled to the first rack 150 and may restrict the first sub-board 120. The first holder 140 may restrict upward-downward movement of the first sub-board 120.

In the second state, the height of the kit 100 may be increased by height of the first sub-board 120 exposed upward from the main board 110, as compared with when only the main board 110 is disposed. However, when the first sub-board 120 is fully hidden inside of the main board 110, the height of the kit 100 may be the same as the height of the main board 110.

In the second state, the supporter 180 may be connected to the main board 110. A plurality of supporters 180 may be provided, for example, two supporters may be provided. Any one of the plurality of supporters 180 may be connected to the upper side of the main board 110 and the other one may be connected to the lower side of the main board 110. The supporter 180 connected to the upper side of the main board 110 may seal the portion between the main board 110 and the upper frame 41, and the supporter 180 connected to the lower side of the main board 110 may seal the portion between the main board 110 and the lower frame 42.

Referring to FIG. 4, the first sub-board 120 may be exposed upward from the main board 110 in the third state. In the third state, the second sub-board 130 may be connected to the main board 110 and may be exposed downward from the main board 110.

The first holder 140 may be coupled to the first rack 150 and may restrict the first sub-board 120. The first holder 140 may restrict upward-downward movement of the first sub-board 120.

The second holder 160 may be coupled to the second rack 170 and may restrict the second sub-board 130. The second holder 160 may restrict upward-downward movement of the second sub-board 130.

In the third state, the height of the kit 100 may be increased by a sum of the height of the first sub-board 120 exposed upward from the main board 110 and the height of the second sub-board 130 exposed downward from the main board 110, as compared with when only the main board 110 is disposed.

In the third state, the supporter 180 may be connected to each of the first sub-board 120 and the second sub-board 130. A plurality of supporters 180 may be provided, for example, two supporters may be provided. Any one of the plurality of supporters 180 may be connected to the upper side of the first sub-board 120 and the other one may be connected to the lower side of the second sub-board 130. The supporter 180 connected to the upper side of the first sub-board 120 may seal the portion between the first sub-board 120 and the upper frame 41, and the supporter 180 connected to the lower side of the second sub-board 130 may seal the portion between the second sub-board 130 and the lower frame 42.

A length H1 of the first sub-board 120 may be smaller than a length H2 of the second sub-board 130. A length ratio of the first sub-board 120 and the second sub-board 130 may be 1:2.

The length H1 of the first sub-board 120 may be smaller than a length H0 of the main board 110. The first sub-board 120 may be completely hidden inside of the main board 110.

The length H0 of the main board 110 may be smaller than the length H2 of the second sub-board 130. The second sub-board 130 may be only partially hidden inside of the main board 110.

Figure 5:
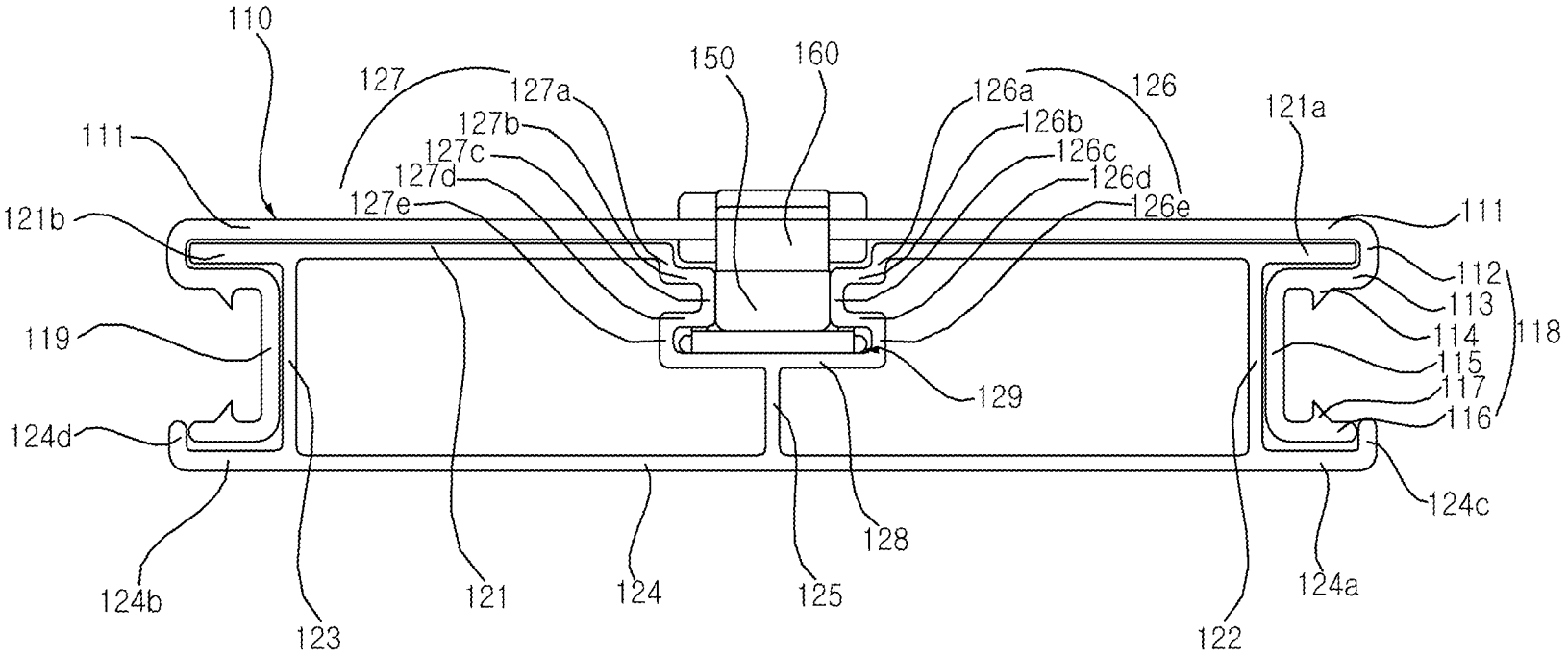
FIG. 5 is a horizontal cross-sectional opened-up view of a kit according to an embodiment.
Figure 6:
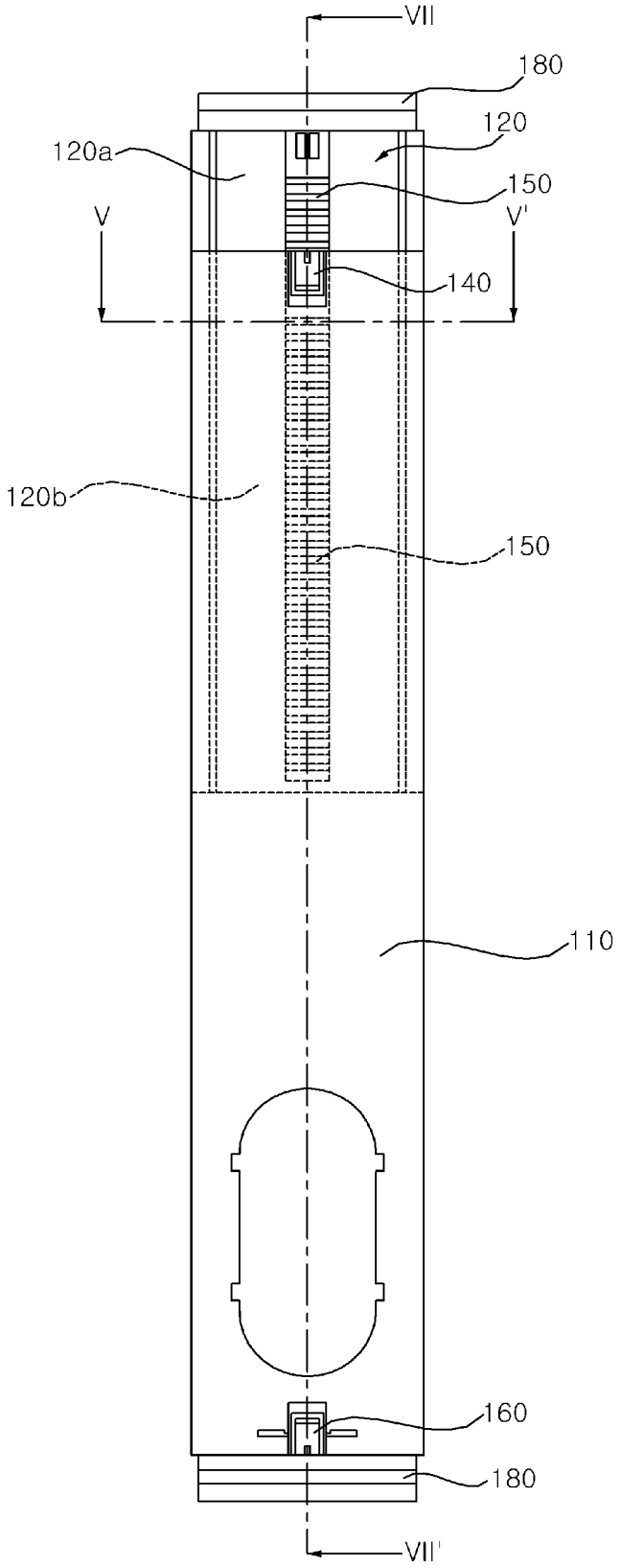
FIG. 6 is a front opened-up view of a kit according to an embodiment.

Hereafter, structure in which the sub-boards 120 and 130 are moved in the vertical direction in the main board 110 will be described with reference to FIGS. 5 and 6. FIG. 5 shows the kit 100 cut along line V-V' shown in FIG. 6, and FIG. 6 shows a shape of the kit 100 seen from a front.

Referring to FIG. 5, the main board 110 may include a main plate 111 at which the discharge port 100*s* is formed, a first side plate 118 that protrudes rearward from the main plate 111, and a second side plate 119 that protrudes rearward from the main plate 111 and is spaced apart from the first side plate 118. The sub-boards 120 and 130 may be moved in the vertical direction between the first side plate 118 and the second side plate 119.

The first side plate 118 and the second side plate 119 may be symmetrically formed with respect to each other. The first side plate 118 and the second side plate 119 may face each other with the main plate 111 therebetween.

A pair of side plates 118 and 119 may include a first wall 112 that protrudes rearward from the main plate 111, a second wall 113 that extends toward a center portion of the main board 110, a first pressing protrusion 114 that protrudes rearward from the second wall 113, a third wall 115 that protrudes rearward from the second wall 113, a fourth wall 116 that extends out of the main board 110 from the third wall 115, and a second pressing protrusion 117 that protrudes forward from the fourth wall 116. The second wall 113 and the fourth wall 116 may be disposed to face each other, and the first pressing protrusion 114 and the second pressing protrusion 117 may be disposed to face each other.

The first sub-board 120 and the second sub-board 130 may have the same horizontal cross-sectional shapes. Hereafter, the first sub-board 120 will be described for convenience of description, but the description for the first sub-board 120 may be the same as for the second sub-board 130.

The first sub-board 120 may include a sub-plate 121 disposed to face the main plate 111, a first sub-side plate 122 that protrudes rearward from the sub-plate 121, a second sub-side plate 123 that protrudes rearward from the sub-plate 121 and spaced apart from the first sub-side plate 122, a rear plate 124 that connects the first sub-side plate 122 and the second sub-side plate 123 and spaced rearward apart from the sub-plate 121, a reinforcing plate 125 that protrudes forward from the rear plate 124, and a recess 129 at which the rack 150 is disposed.

The sub-plate 121 may be disposed in close contact with the main plate 111 and may be disposed in parallel with the main plate 111. The sub-plate 121 may include a first remainder 121*a* that protrudes outward further than the first sub-side plate 122 and a second remainder 121*b* that protrudes outward further than the second sub-side plate 123.

The first remainder 121*a* may be inserted in the first side plate 118 and the second remainder 121*b* may be inserted in the second side plate 119. The first remainder 121*a* and the second remainder 121*b* may be inserted between the main plate 111 and the second wall 113 and may be restricted in outward movement by the first wall 112.

Outward movement of the first sub-side plate 122 may be restricted by the first side plate 118. In particular, outward movement of the first sub-side plate 122 may be restricted by the third wall 115.

Outward movement of the second sub-side plate 123 may be restricted by the second side plate 119. In particular, outward movement of the second sub-side plate 123 may be restricted by the third wall 115.

The rear plate 124 may include a third remainder 124*a* that protrudes outward further than the first sub-side plate 122, a fourth remainder 124*b* that protrudes outward further than the second sub-side plate 123, a first mounting protrusion 124*c* that protrudes forward from the third remainder 124*a*, and a second mounting protrusion 124*d* that protrudes forward from the fourth remainder 124*b*.

The first remainder 124*a* may restrict rearward movement of the first side plate 118. Rearward movement of the fourth wall 116 may be restricted by the first remainder 124*a*. Outward movement of the fourth wall 116 may be restricted by the first mounting protrusion 124*c*.

The first remainder 124*a* may restrict rearward movement of the second side plate 119. Rearward movement of the fourth wall 116 may be restricted by the second remainder 124*b*. Outward movement of the fourth wall 116 may be restricted by the second mounting protrusion 124*d*.

The reinforcing plate 125 may protrude forward from the rear plate 124 and may be connected with the recess 129. The recess 129 may include a first recess wall 126 that protrudes rearward from the sub-plate 121, a second recess wall 127 that protrudes rearward from the sub-plate 121 and spaced apart from the first recess wall 126 to form a space therebetween, and a supporting wall 128 that connects the first recess wall 126 and the second recess wall 127.

The first recess wall 126 may include a first boundary wall 126*a* that protrudes rearward from the sub-plate 121, a second boundary wall 126*b* that extends toward a center portion of the sub-board 120 from the first boundary wall 126*a*, a third boundary wall 126*c* that protrudes rearward from the second boundary wall 126*b*, a fourth boundary wall 126*d* that extends outward from the third boundary wall 126*c*, and a fifth boundary wall 126*e* that protrudes rearward from the fourth boundary wall 126*d*. The second recess wall 127 may be formed symmetrically to the first recess wall 126 with the rack 150 therebetween. The second recess wall 127, the same as the first recess wall 126, may include a first boundary wall 127*a*, a second boundary wall 127*b*, a third boundary wall 127*c*, a fourth boundary wall 127*d*, and a fifth boundary wall 127*e*.

The rack 150 may be disposed between the first recess wall 126 and the second recess wall 127 and rearward movement thereof may be restricted by the supporting wall 128. Lateral or left-right movement of a plurality of partition protrusions 152 (see FIG. 8) described hereinafter may be restricted by the first recess wall 126 and the second recess wall 127. Left-right movement of the partition protrusions 152 may be restricted by a pair of third boundary walls 127*c*. Left-right movement of a rack frame 151 (see FIG. 8) described hereinafter may be restricted by the first recess wall 126 and the second recess wall 127, and rearward movement thereof may be restricted by the supporting wall 128. At least a portion of the rack frame 151 may be inserted between the fourth boundary wall 127*d* and the supporting wall 128 and outward movement thereof may be restricted by the fifth boundary wall 127*e*.

At least a portion of the holder 160 may be disposed between the first recess wall 126 and the second recess wall 127 and movement thereof may be restricted by the first recess wall 126 and the second recess wall 127. At least a portion of the holder 160 may be disposed between a pair of first boundary walls 126*a* and 127*a*, and left-right movement thereof may be restricted by the pair of first boundary walls 126*a* and 127*a*. Rearward movement of at least a portion of the holder 160 may be restricted by a pair of second boundary walls 126*b* and 127*b*.

The sub-board 120 may be moved in the vertical direction in an overlap space 110*s* (see FIG. 13A) formed behind the main board 110. The overlap space 110*s* may refer to a space formed between the first side plate 118 and the second side plate 119. The main plate 111, the first side plate 118, and the second side plate 119 may support the sub-board 120 such that the sub-board 120 is not separated from the main board 110 when the sub-board 120 is moved in the vertical direction.

Referring to FIG. 6, the sub-board 120 may be at least partially hidden inside of the main board 110 while moving in the vertical direction in the overlap space 110*s*. The holder 140 may restrict the sub-board 120 through coupling to the rack 150 such that the sub-board 120 is no longer moved in the vertical direction.

The sub-board 120, in a restricted state, may be divided into a first part 120*a* exposed upward from the main board 110 and a second part 120*b* hidden inside of the main board 110. The rack 150 positioned at the first part 120*a* may be exposed upward from the main board 110 and the rack 150 positioned at the second part 120*b* may be hidden inside of the main board 110. It is possible to increase a height of the kit 100 by a height of the first part 120*a* by adjusting an exposure length of the first part 120*a* through coupling of the holder 140 and the rack 150.

Figure 7:
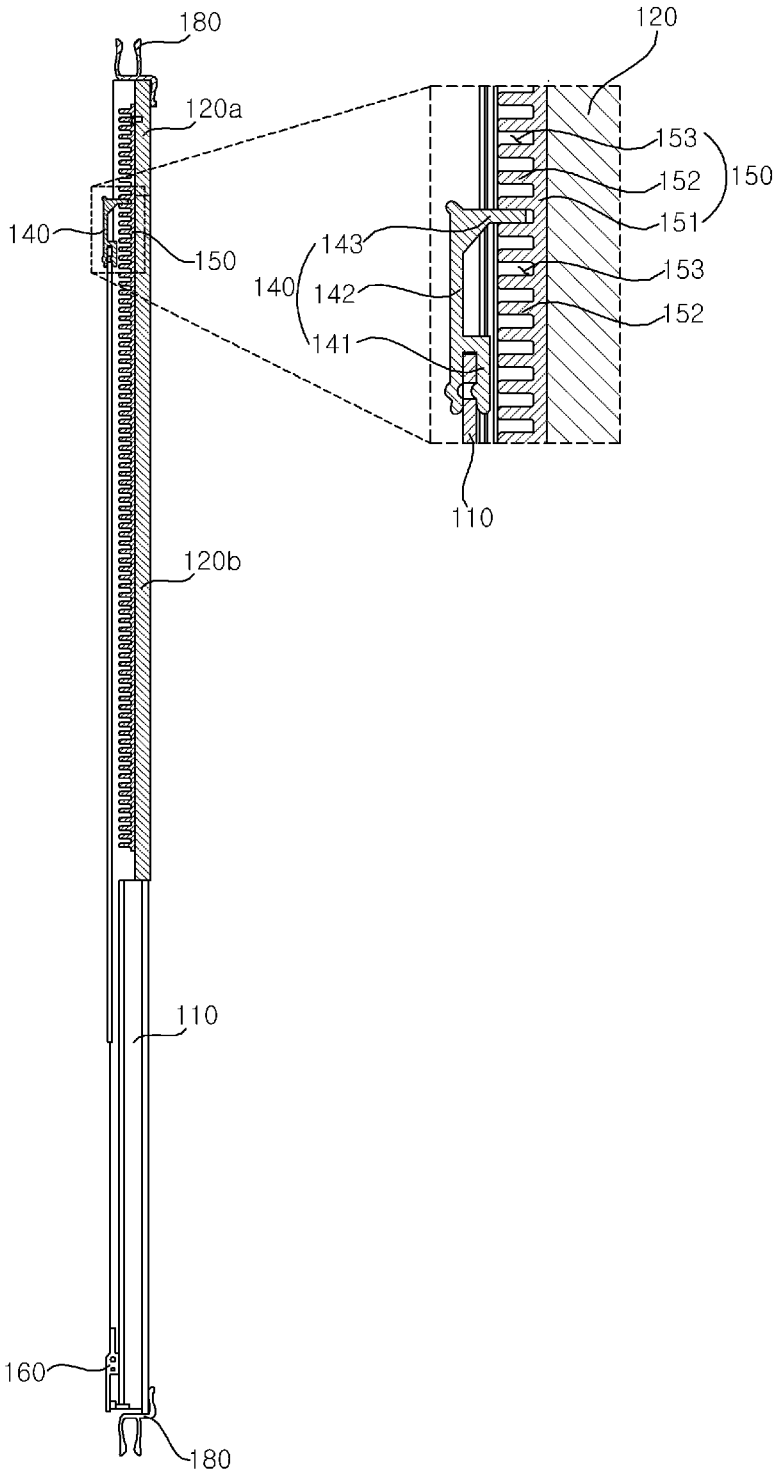
FIG. 7 is a vertical cross-sectional opened-up view of a kit according to an embodiment.
Figure 8:
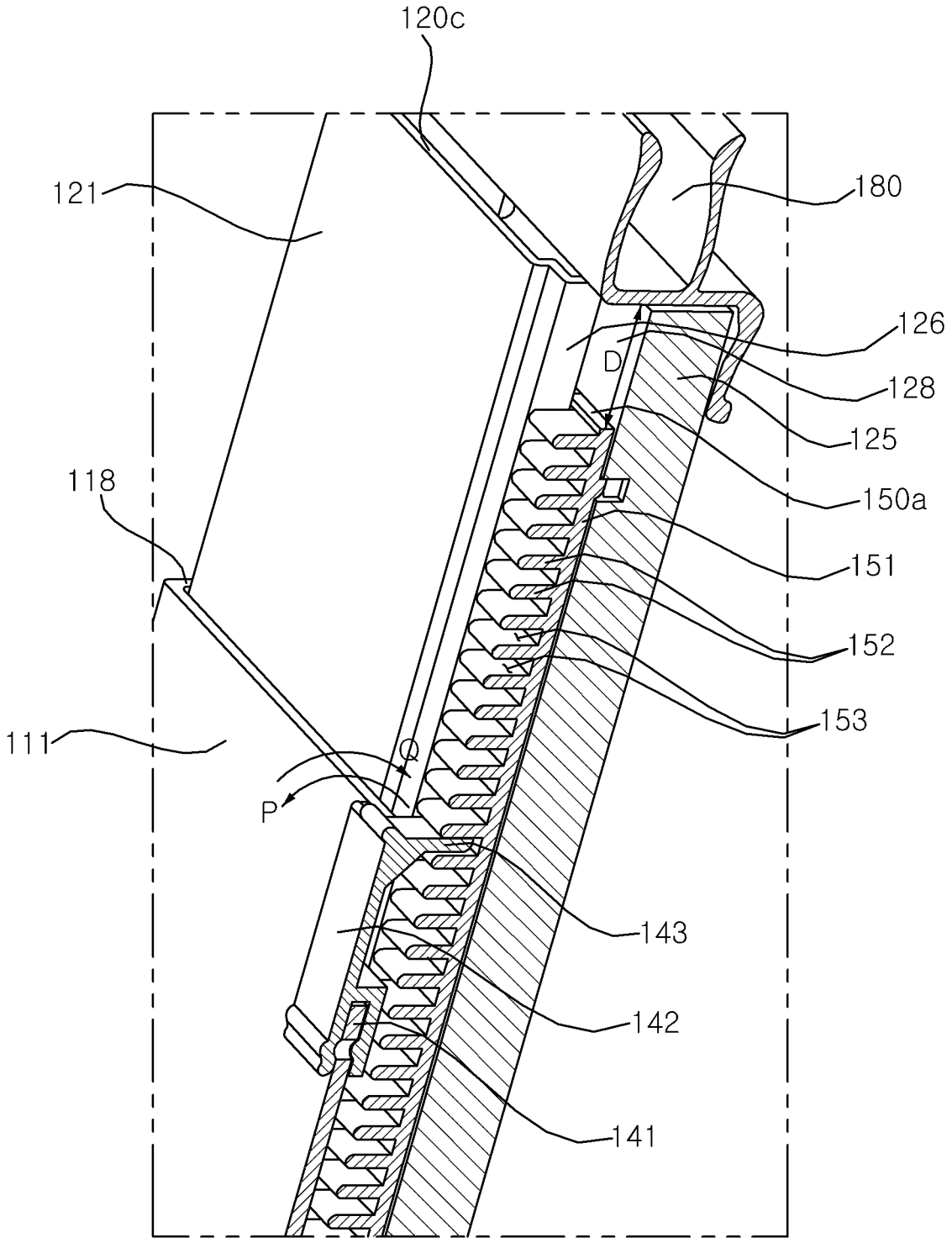
FIG. 8 is a cut view of a kit according to an embodiment.

Hereafter, a coupling relationship of holder 140 and rack 150 will be described with reference to FIGS. 7 and 8. FIG. 7 shows the kit 100 cut along line VII-VII' shown in FIG. 6, and FIG. 8 shows the shape obliquely seen from above.

The holder 140 may include a supporting portion 141 fixed to the main board 110, a grip 142 that extends in the upward-downward direction from the supporting portion 141, and a protrusion 143 that protrudes rearward from the grip 142 and spaced apart from the supporting portion 141 in the upward-downward direction. When the holder 140 is fixed to the sub-board 120, the supporting portion 141 may be fixed to the sub-board 120.

In the first holder 140, the grip 142 may extend upward from the supporting portion 141 and the protrusion 143 may be positioned over the supporting portion 141. In the second holder 160, the grip 142 may extend downward from the supporting portion 141 and the protrusion 143 may be positioned under the supporting portion 141. The supporting portion 141, the grip 142, and the protrusion 143 may be integrally formed and may be made of a material that is elastically deformed.

The supporting portion 141 may be fixed to the main board 110 without moving. The grip 142 may be moved forward and rearward with respect to the supporting portion 141 by elastically deforming. The protrusion 143 that protrudes rearward from the grip 142 may be moved forward and rearward with the grip 142 when the grip 142 is moved forward and rearward. Left-right movement and rearward movement of the supporting portion 141 may be restricted by the recess 129.

The rack 150 may include rack frame 151 that extends in the upward-downward direction, a plurality of partition protrusions 152 that protrudes forward from the rack frame 151, and a plurality of grooves 153 formed between the plurality of partition protrusions 152. The plurality of partition protrusions 152 may be spaced apart from each other in the upward-downward direction and may be disposed in parallel with each other. The plurality of grooves 153 may be formed between the plurality of partition protrusions 152, respectively, and may be spaced apart from each other in the upward-downward direction. The protrusion 143 may be moved rearward and inserted into one of the plurality of grooves 153 and may be moved forward and separated out of the one of the plurality of grooves 153.

When the grip 142 is pulled in a first direction P, the protrusion 143 may be separated out of the groove 153. When the protrusion 143 is separated out of the groove 153, the sub-board 120 may be moved in the vertical direction without being restricted by the main board 110.

When the grip 142 is pushed in a second direction Q, the protrusion 143 may be inserted into the groove 153. When the protrusion 143 is inserted in the groove 153, the sub-board 120 is restricted by the main board 110 and upward-downward movement thereof is restricted.

The protrusion 143 may be selectively inserted into the groove 153 corresponding to the protrusion 143 in a frontward-rearward direction of the plurality of grooves 153. Accordingly, it is possible to adjust the height of the kit 100 by changing the groove 153 corresponding to the protrusion 143 by moving the sub-board 120 in the vertical direction with respect to the main board 110.

The coupling structure of the first holder 140 and the first rack 150 described above may be applied in the same way to the coupling structure of the second holder 160 and the second rack 170. However, the second holder 160, unlike the first holder 140, has the grip and the protrusion under the supporting portion, so there may be a slight difference in forward and rearward movement directions. As for the second holder 160, it is possible to express that when the grip and the protrusion are moved forward with respect to the main board 110, the protrusion is separated out of the groove of the rack, and when the grip and the protrusion are moved rearward with respect to the main board 110, the protrusion is inserted into the groove of the rack.

The rack 150 may be spaced apart from an end 120*c* of the sub-board 120. An uppermost end 150*a* of the rack frame 151 may be positioned lower than the upper end portion 120*c* of the sub-board 120. The uppermost end 150*a* of the rack frame 151 may be spaced a predetermined distance D downward apart from the upper end portion 120*c* of the sub-board 120.

Figure 9:
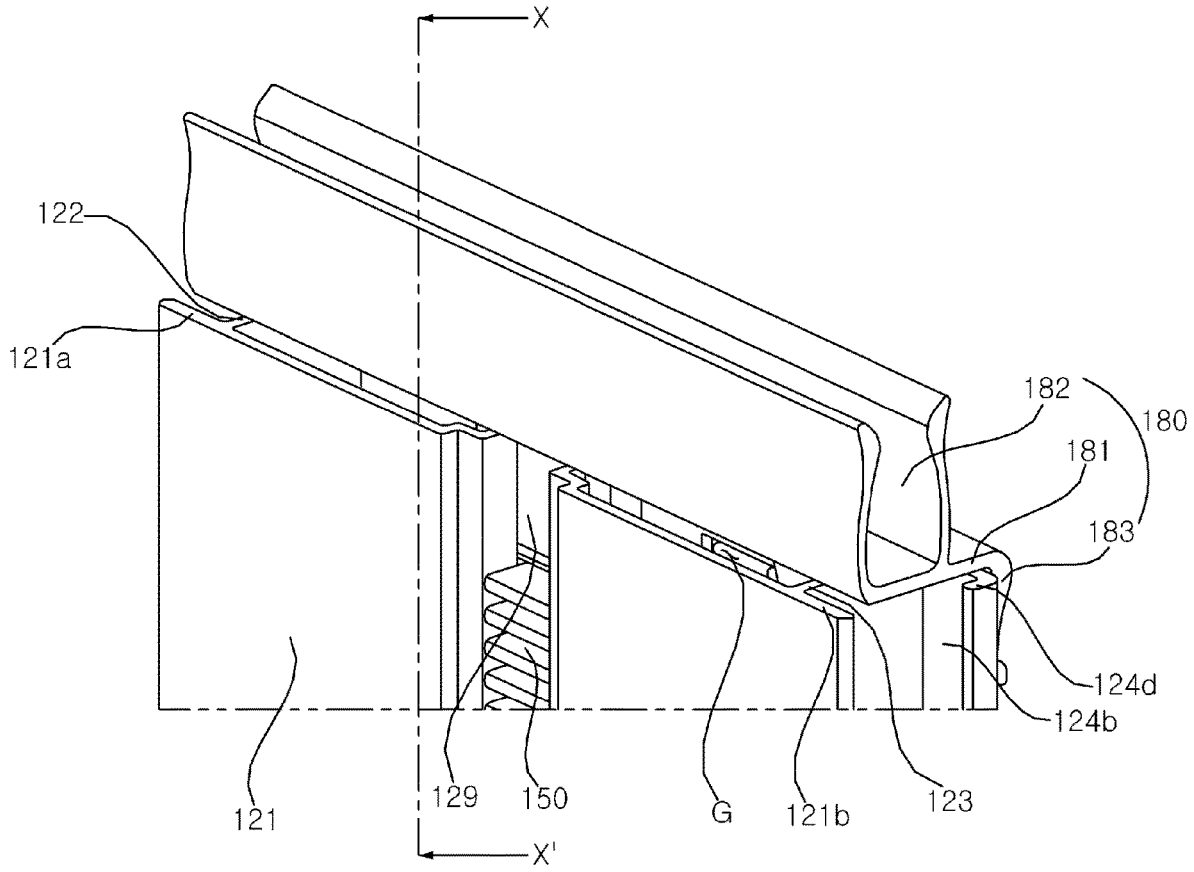
FIG. 9 is an enlarged view of a supporter according to an embodiment.
Figure 10:
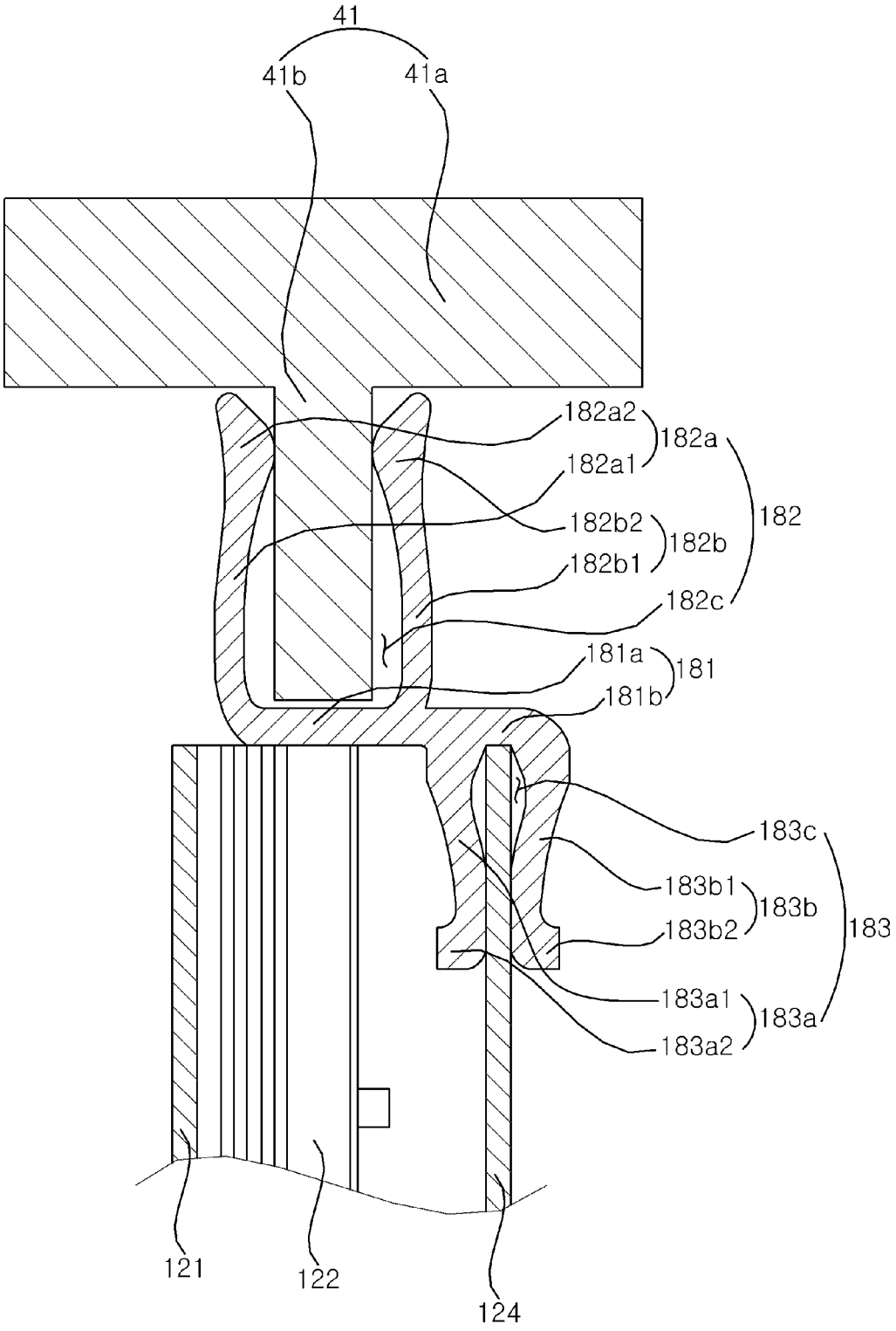
FIG. 10 is a vertical cross-sectional opened-up view of the supporter according to an embodiment, taken along line XX' of FIG. 9.

Hereafter, a disposition structure of supporter 180 will be described with reference to FIGS. 9 and 10. FIG. 9 is an enlarged view showing a portion of the kit 100 at which the supporter 180 is disposed, and FIG. 10 is a view of the kit 100 at which the supporter 180 is disposed, taken along line X-X' shown in FIG. 9.

The supporter 180 may include a supporting plate 181 seated on the sub-board 120, a first supporting body 182 that protrudes upward from the supporting plate 181 and having a window frame groove 182*c* in which the window frame 140 is inserted, and a second supporting body 183 that protrudes downward from the supporting plate 181 and having a board groove 183*c* in which a portion of the sub-board 120 is inserted. The supporting plate 181, the first supporting body 182, and the second supporting body 183 may be integrally formed.

The supporter 180 may be attached/detached to/from an upper side of the first sub-board 120 and may be attached/detached to/from a lower side of the second sub-board 130. The rear plate 124 of the first sub-board 120 may be inserted into the board groove 183*e* and the supporter 180 may be connected to the first sub-board 120 by fitting the second supporting body 183 to the rear plate 124. The supporting plate 181 may be seated on the upper side of the first sub-board 120 with the supporter 180 connected to the first sub-board 120. A weight of the supporter 180 may be supported by the first sub-side plate 122, the second sub-side plate 123, the rear plate 124, and the recess 129.

The supporting plate 181 may be positioned rearward further than the sub-plate 121. A gap G may be formed between the supporting plate 181 and the sub-plate 121.

The weight of the supporting plate 181 may be supported by the third remainder 124*a* and the fourth remainder 124*b* and the supporting plate 181 may be disposed closer to the center portion of the sub-board 120 than the first mounting protrusion 124*c* and the second mounting protrusion 124*d*. The supporting plate 181 may be disposed inside of the first mounting protrusion 124*c* and the second mounting protrusion 124*d* and may be disposed between the first mounting protrusion 124*c* and the second mounting protrusion 124*d*.

The supporting plate 181 may include a first base plate 181*a* which is a portion at which the first supporting body 182 protrudes, and a second base plate 181*b* which is a portion at which the second supporting body 183 protrudes. The first base plate 181*a* and the second base plate 181*b* may be integrally formed.

The first supporting body 182 may protrude upward from the first base plate 181*a*, and the second supporting body 183 may protrude upward from the second base plate 181*b*. The first supporting body 182 and the second supporting body 183 may not overlap in the vertical direction.

The first supporting body 182 may include a first window frame holder 182*a* that protrudes upward from the supporting plate 181, a second window frame holder 182*b* that protrudes upward from the supporting plate 181 and spaced rearward apart from the first window frame holder 182*a*, and a window frame groove 182*c* formed between the first window frame holder 182*a* and the second window frame holder 182*b*. The first window frame holder 182*a* may include a first holding plate 182*a*1 that extends upward from the supporting plate 181, and a first holding protrusion 182*a*2 that protrudes rearward from the first holding plate 182*a*1. The second window frame holder 182*a* may include a second holding plate 182*b*1 that extends upward from the supporting plate 181, and a second holding protrusion 182*b*2 that protrudes forward from the second holding plate 182*b*1. A width of the window frame groove 182*c* may decrease upward.

The upper frame 41 may include a base frame 41*a* that transversely extends, and a fixing frame 41*b* that protrudes downward from the base frame 41*a*. The fixing frame 41*b* may fix the kit 100 to the window frame 40 by being inserted in the window frame groove 182*c*. The fixing frame 41*b* may be disposed between the first holding plate 182*a*1 and the second holding plate 182*b*1 and may be pressed by the first holding protrusion 182*a*2 and the second holding protrusion 182*b*2.

The second supporting body 183 may include a first board holder 183*a* that protrudes downward from the supporting plate 181, a second board holder 183*b* that protrudes downward from the supporting plate 181 and spaced rearward apart from the first board holder 183*a*, and a board groove 183*c* formed between the first board holder 183*a* and the second board holder 183*b*. The first board holder 183*a* may include a third holding plate 183*a*1 that extends downward from the supporting plate 181, and a first reinforcing protrusion 183*a*2 that protrudes forward from the third holding plate 183*a*1. The third holding plate 183*a*1 may have a shape that protrudes rearward downward. The second board holder 183*b* may include a fourth holding plate 183*b*1 that extends downward from the supporting plate 181, and a second reinforcing protrusion 183*b*2 that protrudes rearward from the fourth holding plate 182*b*1. The fourth holding plate 183*b*1 may have a shape that protrudes forward downward. A width of the board groove 183*c* may decrease downward.

The rear plate 124 may fix the sub-board 120 to the supporter 180 by being inserted in the board groove 183*c*. The rear plate 124 may be disposed between the third holding plate 183*a*1 and the fourth holding plate 183*b*1 and may be pressed by the third holding protrusion 183*a*1 and the fourth holding plate 183*b*1.

Figure 11A:
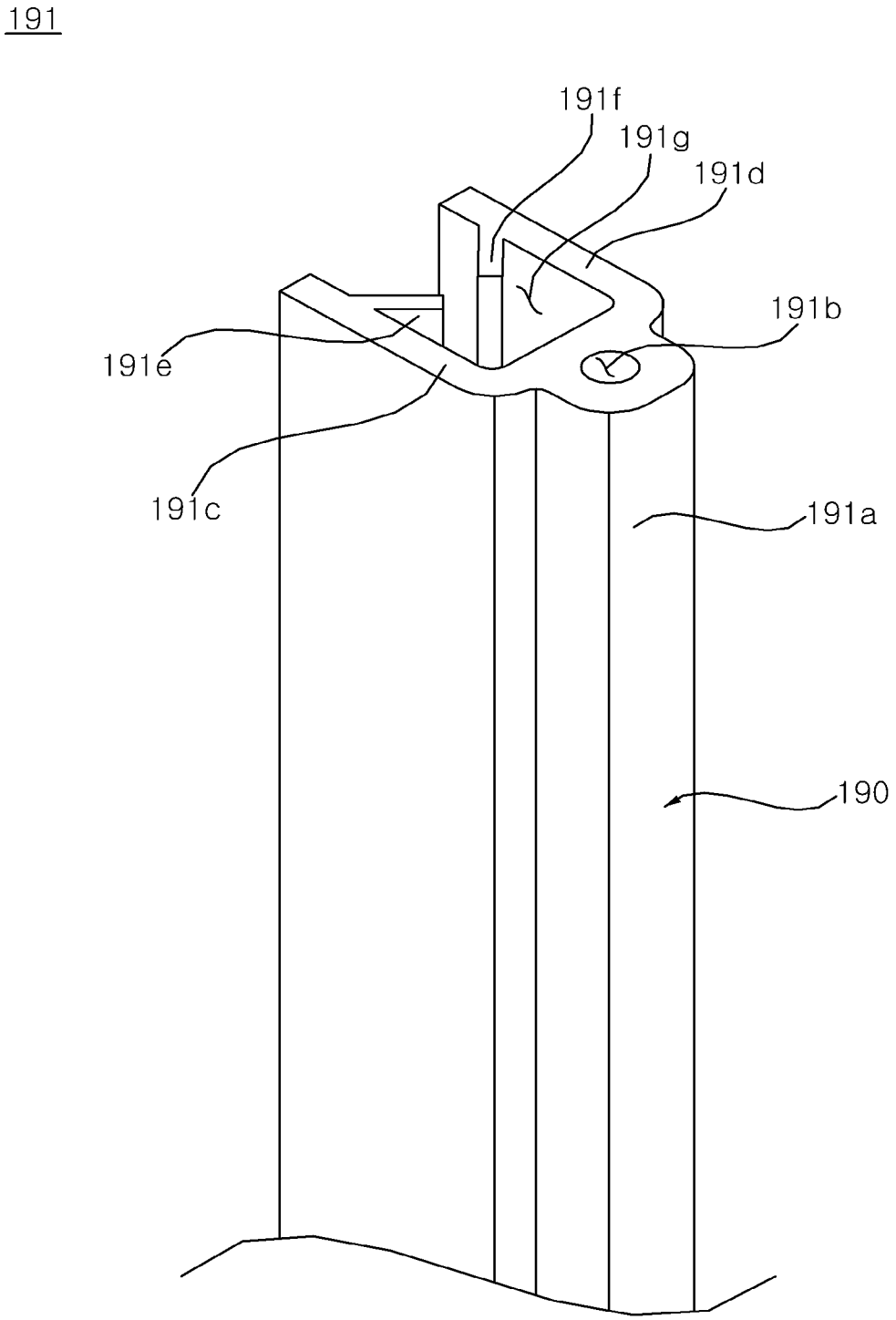
FIG. 11A is a perspective view of a first gasket according to an embodiment.
Figure 11B:
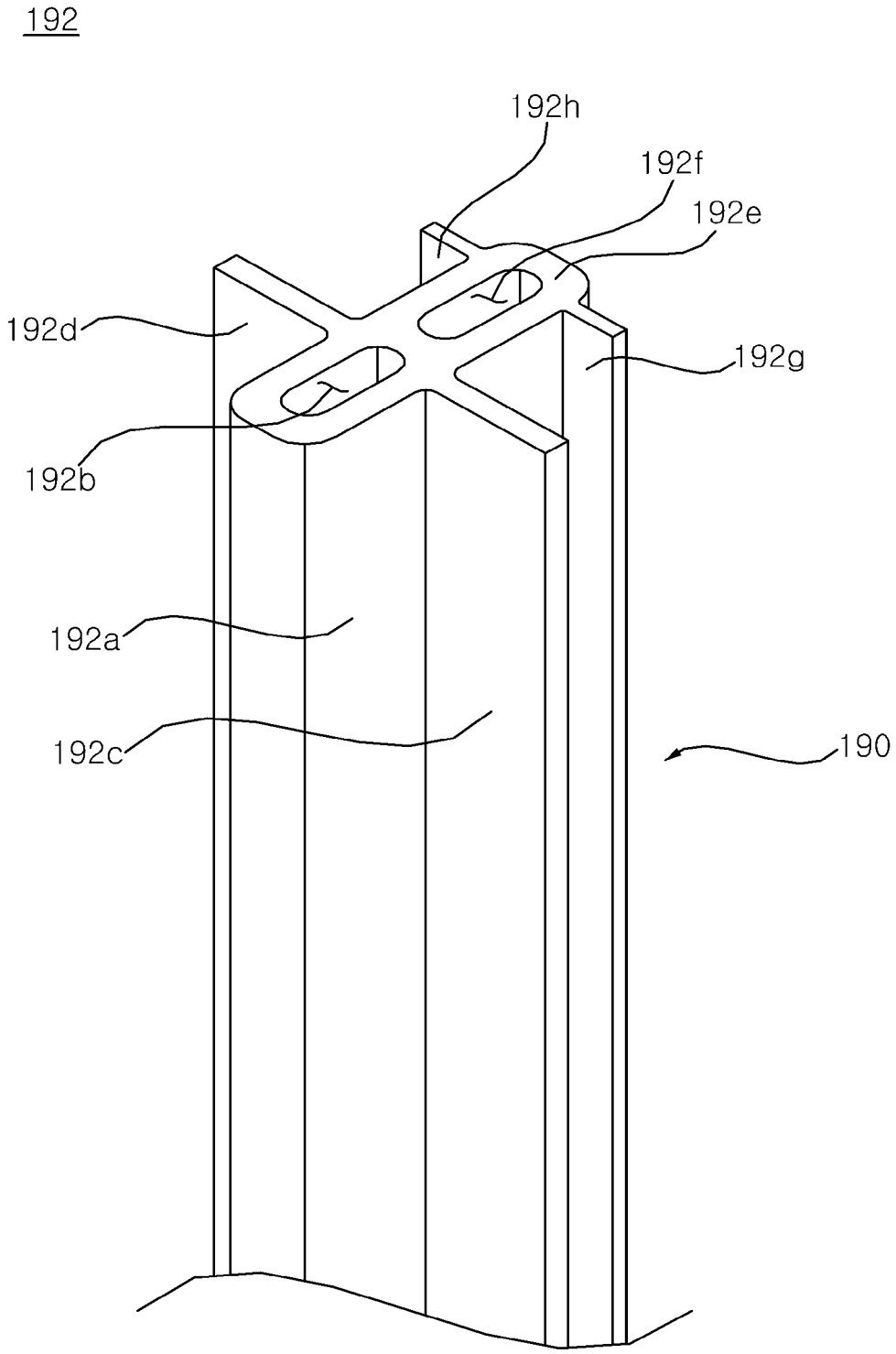
FIG. 11B is a perspective view of a second gasket according to an embodiment.

Hereafter, gaskets 191 and 192 will be described with reference to FIGS. 11A and 11B. FIG. 11A is a perspective view of the first gasket 191 which is inserted in the window 30 and FIG. 11B is a perspective view of the second gasket 192 which is inserted in the window frame 40.

The kit 100 may include gasket 190 disposed between a side of each of the main board 110 and the sub-boards 120 and 130 and the window frame 40. The gasket 190 may be disposed between the side of each of the main board 110 and the sub-boards 120 and 130 and the window 30.

The gasket 190 may include a first gasket 191 disposed between the side of each of the main board 110 and the sub-boards 120 and 130 and the window 30, and a second gasket 192 disposed between the side of each of the main board 110 and the sub-boards 120 and 130 and the window frame 40. The first gasket 191 may be inserted in the third window frame 33 and the second gasket 192 may be inserted in the side frame 43.

Referring to FIG. 11A, the first gasket 191 may include a first kit sealer 191*a* inserted in the main board 110 and the sub-boards 120 and 130, a first sealer hole 191*b* open in the vertical direction at the first kit sealer 191*a*, a first window sealer 191*c* that protrudes to a side from the first kit sealer 191*a*, a second window sealer 191*d* that protrudes to a side from the first kit sealer 191*a* and spaced apart from the first window sealer 191*c*, a first sealer protrusion 191*e* that protrudes toward the second window sealer 191*d* from the first window sealer 191*c*, a second sealer protrusion 191*f* that protrudes toward the first window sealer 191*c* from the second window sealer 191*d*, and a window insertion groove 191*g* formed between the first window sealer 191*c* and the second window sealer 191*d*.

Referring to FIG. 11B, the second gasket 192 may include a second kit sealer 192*a* inserted in the main board 110 and the sub-boards 120 and 130, a first sealer hole 192*b* open in the vertical direction at the second kit sealer 192*a*, a first rib 192*c* that protrudes outward from the second kit sealer 192*a*, a second rib 192*d* that protrudes outward from the second kit sealer 192*a* and that faces the first rib 192*c*, a window frame sealer 192*e* facing the second kit sealer 192*a* with the first rib 192*c* and the second rib 192*d* therebetween, a window frame sealer hole 192*f* open in the vertical direction at the window frame sealer 192*e*, a third rib 192*g* that protrudes outward from the window frame sealer 192*e*, and a fourth rib 192*h* that protrudes outward from the window frame sealer 192*e* and facing the third rib 192*g*.

Figure 12A:
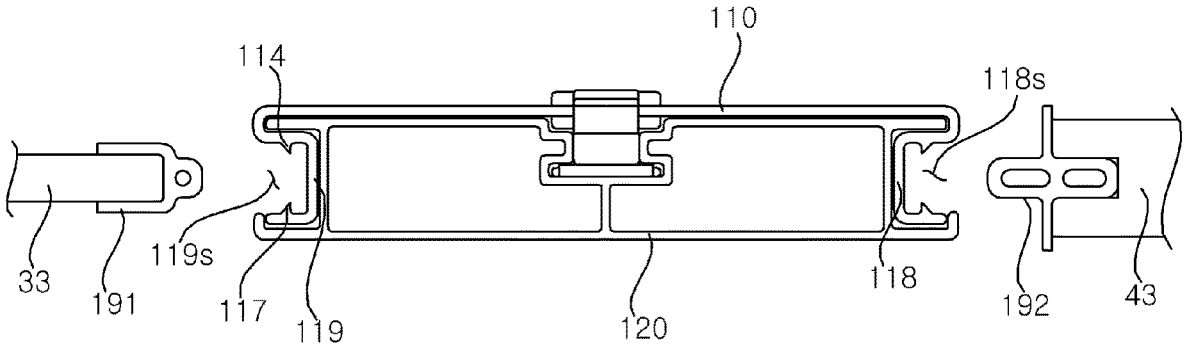
FIG. 12A is a horizontal cross-sectional view of a kit according to an embodiment before it is sealed.
Figure 12B:
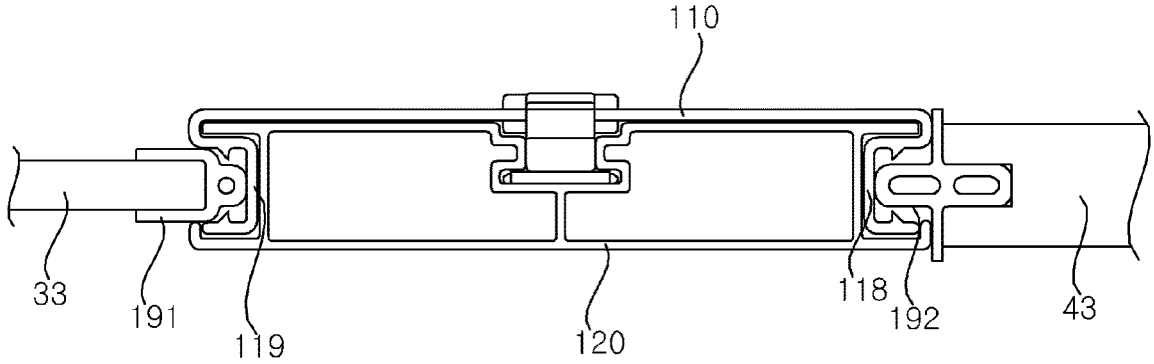
FIG. 12B is a horizontal cross-sectional view of the kit according to an embodiment after it is sealed.

Hereafter, a sealing structure by the gasket 190 will be described with reference to FIGS. 12A and 12B. FIG. 12A shows the kit 100 before it is sealed by the gasket 190 and FIG. 11B shows an installation structure of the kit 100 after it is sealed by the gasket 190.

A first gasket groove 118*s* in which the second gasket 192 may be inserted may be formed at the first side plate 118. A second gasket groove 119*s* in which the first gasket 191 may be inserted may be formed at the second side plate 119. The first gasket groove 118*s* and the second gasket groove 119*s* may be referred to as "gasket grooves".

The third window frame 33 may be inserted in the window insertion groove 191*g* and may be pressed by the first sealer protrusion 191*e* and the second sealer protrusion 191*f*. The first gasket 191 may be inserted in the second gasket groove 119*s* and may be pressed by the first pressing protrusion 114 and the second pressing protrusion 117. The first kit sealer 191*a* may seal the portion between the main board 110 and the sub-boards 120 and 130 by being inserted in the second gasket groove 119*s*.

The window frame sealer 192*e* may be inserted in the side frame 43, and the third rib 192*g* and the fourth rib 192*h* may be pressed to the side frame 43. The side frame 43 may be in close contact with the first rib 192*c* and the second rib 192*d*.

The second gasket 192 may be inserted in the first gasket groove 118*s* and may be pressed by the first pressing protrusion 114 and the second pressing protrusion 117. The second kit sealer 192*a* may seal the portion between the main board 110 and sub-boards 120 and 130 and the side frame 43 by being inserted in the first gasket groove 118*s*.

Figure 13A:
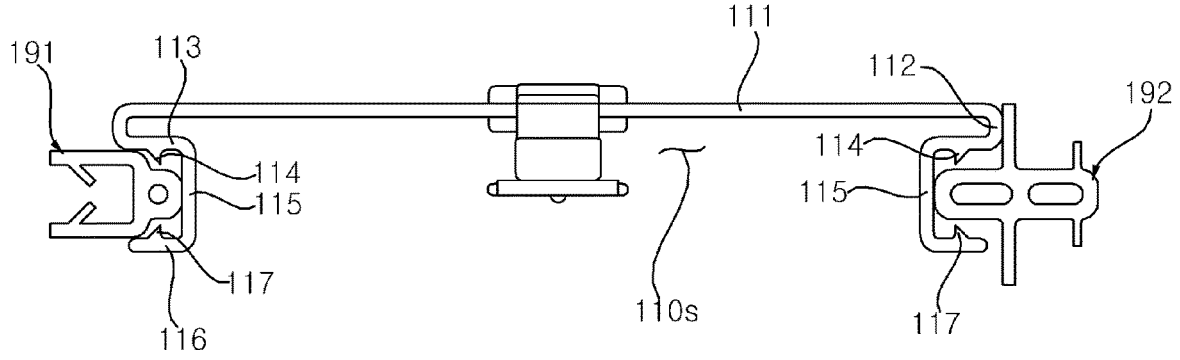
FIG. 13A is a view illustrating a connection structure of a main board and a gasket according to an embodiment.
Figure 13B:
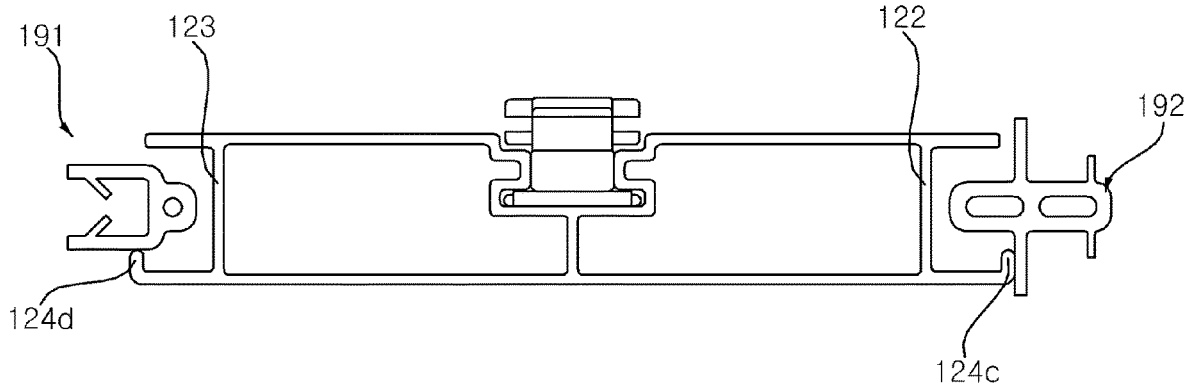
FIG. 13B is a view illustrating a connection structure of a sub-board and a gasket according to an embodiment.

Hereafter, a close contact structure of the gasket 190 will be described with reference to FIGS. 13A and 13B. FIG. 13A is a view illustrating a close contact structure of the main board 110 and the gasket 190, and FIG. 13B is a view illustrating a close contact structure of the sub-boards 120 and 130 and the gasket 190.

Referring to FIG. 13A, the first gasket 191 may be in closed contact with the second side plate 119 and the second gasket 192 may be in close contact with the first side plate 118. The first kit sealer 191*a* may be in close contact with the third wall 115 and may be disposed between the first pressing protrusion 114 and the second pressing protrusion 117.

The first window sealer 191*c* may be in close contact with the second wall 113 and the second window sealer 119*d* may be in close contact with the fourth wall 116. The first window sealer 191*c* may be positioned further outside than the first pressing protrusion 114 and the second window sealer 191*d* may be positioned further outside than the second pressing protrusion 117.

The second kit sealer 192*a* may be in close contact with the third wall 115 and may be disposed between the first pressing protrusion 114 and the second pressing protrusion 117. The first rib 192*c* may be in close contact with the first wall 112 and the second rib 192*d* may be spaced outward apart from the fourth wall 116.

Referring to FIG. 13B, the first gasket 191 may be in closed contact with the second sub-side plate 123 and the second gasket 192 may be in close contact with the first sub-side plate 122. The first gasket 191 may be in close contact with the second mounting protrusion 124*d* in a state in which the first gasket 191 is inserted in the second gasket groove 119*s*. The second window sealer 191*d* may be supported in close contact with the second mounting protrusion 124*d*.

The second gasket 192 may be in close contact with the first mounting protrusion 124*c* in a state in which the second gasket 192 is inserted in the first gasket groove 118*s*. The second rib 192*d* may be supported in close contact with the first mounting protrusion 124*c*. The first mounting protrusion 124*c* and the second mounting protrusion 124*d* may be referred to as "gasket holding portions" that protrude forward from the rear plate 124.

Embodiments disclosed herein provide an air conditioner equipped with a kit a height of which is easily adjusted. Embodiments disclosed herein further provide an air conditioner equipped with a kit having increased durability against external forces. Embodiments disclosed herein furthermore provide an air conditioner equipped with a kit having an increased lifespan.

Embodiments disclosed herein provide an air conditioner equipped with a kit preventing inflow of external forces. Embodiments disclosed herein also provide an air conditioner in which the fitting compatibility of a kit is improved.

Advantages are not limited to the advantages described above and other advantages will be clearly understood by those skilled in the art from the description.

Embodiments disclosed herein provide an air conditioner that may include a case in which a heat exchanger is disposed and that has an air inlet and an air outlet; a discharge pipe that communicates with the air outlet and extends out of the case; and a kit that has a discharge port in which the discharge pipe is fixed, and disposed to be fixed to a window frame. The kit may include a main board at which the discharge port is formed; a sub-board that is disposed to be movable in the vertical direction with respect to the main board; a rack that is connected with any one of the main board and the sub-board and forms a plurality of grooves spaced apart from each other in an upward-downward direction; and a holder that is connected with the other one of the main board and the sub-board and has a protrusion inserted in the groove and moving forward and rearward to restrict upward-downward movement of the sub-board. It is possible to adjust a height of the kit by restricting upward-downward movement of the sub-board by inserting the protrusion in the groove.

The rack may be connected with the sub-board and the holder may be connected with the main board. The holder may include a supporting portion or support fixed to any one of the main board and the sub-board and spaced apart from the protrusion, and a grip that connects the supporting portion and the protrusion. The holder may be disposed at an end of any one of the main board and the sub-board.

The rack may include a plurality of partition protrusions forming the groove therebetween by being spaced apart from each other in the upward-downward direction. The rack may be disposed to be spaced apart from an end of any one of the main board and the sub-board.

The sub-board may include a first sub-board at least a portion of which is disposed at an upper side of the main board, and a second sub-board at least a portion of which is disposed at a lower side of the main board. The first sub-board and the second sub-board may extend in the upward-downward direction.

A length of the first sub-board may be smaller than a length of the second sub-board. The discharge port may be formed at a position closer to the second sub-board than the first sub-board.

The holder may include a first holder that corresponds to the first sub-board, and a second holder that corresponds to the second sub-board. A grip of the first holder may be disposed higher than the supporting portion, and a grip of the second holder may be positioned lower than the supporting portion. An overlap space in which the sub-board is moved in the vertical direction may be formed behind the main board.

The main board may include a main plate at which the discharge port is formed; a first side plate that protrudes rearward from the main plate; and a second side plate that protrudes rearward from the main plate and spaced apart from the first side plate. The sub-board may be moved in the vertical direction between the first side plate and the second side plate.

The kit may further include a supporter that is attached/detached to/from at least any one of the main board and the sub-board. The supporter may include a supporting plate that is seated on any one of the main board and the sub-board; a first supporting body that protrudes to a side from the supporting plate and at which a window frame groove in which the window frame is inserted is formed; and a second supporting body that protrudes to another side from the supporting plate and at which a board groove, in which at least any one of the main board and the sub-board is inserted, is formed. The first supporting body and the second supporting body may not overlap in the upward-downward direction.

The kit may further include a gasket disposed between a side of each of the main board and the sub-board and the window frame. The gasket may include a first gasket inserted in a window, and a second gasket inserted in the window frame.

The main board may include a main plate at which the discharge port is formed, and a side plate that protrudes rearward from the main plate and at which a gasket groove in which the gasket is inserted is formed. The sub-board may include a rear plate spaced rearward apart from the main board, and a gasket holding portion that protrudes forward from the rear plate.

According to an air conditioner according to embodiments disclosed herein, advantages may be achieved as follows.

First, there is an advantage in that a height of the kit may be easily adjusted by adjusting an overlap height of the main board and the sub-board by inserting the protrusion of the holder in any one of the plurality of grooves formed at the rack.

Second, there is another advantage in that a fastening force between the main board and the sub-board is increased through coupling of the holder and the rack, so durability of the kit against external force is increased.

Third, there is another advantage in that a lifespan of the kit is improved by the structure of the holder including the supporting portion, the grip, and the protrusion, and a restriction method of insertion in any one of the plurality of grooves.

Fourth, there is another advantage in that a shape compatibility with a window frame is increased by the supporter and the gasket, so that the kit completely prevents inflow of external air.

Fifth, there is another advantage in that as the sub-board is moved up and down in the overlap space formed inside of the main board, the shape compatibility of the kit is increased.

Advantages are not limited to those described above and other advantages not stated herein may be made apparent to those skilled in the art from claims.

Although embodiments were illustrated and described above, the embodiments are not limited to the disclosed embodiments and may be modified in various ways by those skilled in the art without departing from the scope described in claims, and the modified examples should not be construed independently from the spirit of the scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a case in which a heat exchanger is disposed and having an air inlet and an air outlet;

a discharge pipe that communicates with the air outlet and extends outside of the case; and a kit having a discharge port to which the discharge pipe is fixed, and disposed at a window frame, wherein the kit includes:

a main board in which the discharge port is formed;

a first sub-board configured to be movable up and down with respect to the main board and having a sub plate that extends vertically, a rear plate spaced apart from a rear of the sub plate, and a recess recessed from the sub plate toward the rear plate;

a rack disposed in the recess and including a plurality of grooves spaced apart from each other in an upward-downward direction; and a holder that is connected with the main board, wherein the holder includes:

a protrusion inserted into any one of the plurality of grooves;

a support fixed to the main board; and a grip that extends in a vertical direction to connect the protrusion and the support, and wherein the support is arranged to contact each of outer and inner surfaces of the main board.

2. The air conditioner of claim 1, wherein the rack is connected with the first sub-board and the holder is connected with the main board.

3. The air conditioner of claim 1, wherein the holder is disposed at an end of the main board.

4. The air conditioner of claim 1, wherein the rack includes a plurality of partition protrusions that forms the plurality of grooves therebetween by being spaced apart from each other in the upward-downward direction.

5. The air conditioner of claim 1, wherein the rack is spaced apart from an end of the first sub-board.

6. The air conditioner of claim 1, wherein the kit further includes:

a second sub-board disposed in an opposite direction of the first sub board with respect to the main board.

7. The air conditioner of claim 6, wherein at least a portion of the first sub board is disposed at an upper side of the main board, at least a portion of the second sub board is disposed at a lower side of the main board, wherein the first sub-board and the second sub-board extend in the upward-downward direction, and wherein a length of the first sub-board is smaller than a length of the second sub-board.

8. The air conditioner of claim 6, wherein the discharge port is formed at a position closer to the second sub-board than the first sub-board.

9. The air conditioner of claim 6, wherein the holder includes:

a first holder that corresponds to the first sub-board; and a second holder that corresponds to the second sub-board.

10. The air conditioner of claim 9, wherein the grip of the first holder is disposed higher than the support, and wherein the grip of the second holder is positioned lower than the support.

11. The air conditioner of claim 1, wherein an overlap space in which the first sub-board is moved in the vertical direction is formed behind the main board.

12. The air conditioner of claim 1, wherein the main board includes:

a main plate at which the discharge port is formed;

a first side plate that protrudes rearward from the main plate; and a second side plate that protrudes rearward from the main plate and spaced apart from the first side plate, and wherein the first sub-board is moved up and down between the first side plate and the second side plate.

13. The air conditioner of claim 1, wherein the kit further includes a supporter that is detachable from any one of the main board or the first sub-board.

14. The air conditioner of claim 13, wherein the supporter includes:

a supporting plate that is seated on the first sub-board;

a first supporting body that protrudes at a first side from the supporting plate and in which a window frame groove in which the window frame is inserted is formed; and a second supporting body that protrudes at a second side from the supporting plate and in which a board groove, in which the first sub-board is inserted, is formed.

15. The air conditioner of claim 14, wherein the first supporting body and the second supporting body do not overlap in the upward-downward direction.

16. The air conditioner of claim 1, wherein the kit further includes a gasket disposed between a side of the main board and the window frame, and wherein the gasket is disposed between a side of the first sub board and the window frame.

17. The air conditioner of claim 16, wherein the gasket includes:

a first gasket inserted in a window; and a second gasket inserted in the window frame.

18. The air conditioner of claim 16, wherein the main board includes:

a main plate in which the discharge port is formed; and a side plate that protrudes rearward from the main plate and in which a gasket groove in which the gasket is inserted is formed.

19. The air conditioner of claim 16, wherein the first sub-board includes:

a gasket holding portion that protrudes forward from the rear plate.

20. An air conditioner, comprising:

a case in which a heat exchanger is disposed and having an air inlet and an air outlet;

a discharge pipe that communicates with the air outlet and extends outside of the case; and a kit having a discharge port to which the discharge pipe is fixed, and disposed at a window frame, wherein the kit includes:

a main board in which the discharge port is formed;

a first sub-board configured to be movable up and down with respect to the main board and having a first sub plate that extends vertically, a first rear plate spaced apart from a rear of the first sub plate, and a first recess recessed from the first sub plate toward the first rear plate;

a second sub-board configured to be movable up and down with respect to the main board and having a second sub plate that extends vertically, a second rear plate spaced apart from the second rear of the sub plate, and a second recess recessed from the second sub plate toward the second rear plate;

a first rack disposed in the first recess and including a plurality of first grooves spaced apart from each other in an upward-downward direction;

a second rack disposed in the second recess and including a plurality of second grooves spaced apart from each other in the upward-downward direction;

a first holder that is connected with the main board and configured to engage with the first rack to restrict upward-downward movement of the first sub-board; and a second holder that is connected with the main board and configured to engage with the second rack to restrict upward-downward movement of the second sub-board, wherein each of the first holder and the second include:

a protrusion inserted into one of the plurality of first grooves or the plurality of second grooves;

a support fixed to the main board; and a grip that extends in a vertical direction to connect the protrusion and the support, and wherein the support is arranged to contact each of outer and inner surfaces of the main board.

21. The air conditioner of claim 20, at least a portion of the first side board is disposed at an upper side of the main board, wherein at least a portion of the second side board is disposed at a lower side of the main board, wherein the first sub-board and the second sub-board extend in the upward-downward direction, and wherein a length of the first sub-board is smaller than a length of the second sub-board.

22. The air conditioner of claim 21, wherein the discharge port is formed at a position closer to the second sub-board than the first sub-board.

23. The air conditioner of claim 21, wherein each of the first holder and the second holder includes:

a support fixed to the main board and spaced apart from the protrusion; and a grip that connects the support and the protrusion, wherein the grip of the first holder is disposed higher than the support, and wherein the grip of the second holder is positioned lower than the support.

* * * * *